US006891332B1

(12) United States Patent
Irisawa et al.

(10) Patent No.: US 6,891,332 B1
(45) Date of Patent: May 10, 2005

(54) ARC TUBE CAPABLE OF PREVENTING OCCURRENCE OF LEAK DUE TO CRACKS AND MANUFACTURING METHOD THEREFORE

(75) Inventors: Shinichi Irisawa, Shizuoka (JP); Yoshitaka Ohshima, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 542 days.

(21) Appl. No.: 09/599,726

(22) Filed: Jun. 23, 2000

(30) Foreign Application Priority Data

Jun. 25, 1999 (JP) ..... 11-180411

(51) Int. Cl.[7] ..... H01J 17/04; H01J 9/32

(52) U.S. Cl. ..... 313/631; 313/634; 313/331; 313/332; 313/623; 313/624; 313/625; 445/24; 445/25; 445/26

(58) Field of Search ..... 313/631–634, 313/331, 332, 623, 624, 625; 445/26, 24, 25

(56) References Cited

U.S. PATENT DOCUMENTS

| | | | | | |
|---|---|---|---|---|---|
| 4,587,454 | A | * | 5/1986 | Bonazoli et al. | 174/50.64 |
| 4,910,430 | A | * | 3/1990 | Ito et al. | 313/566 |
| 5,286,227 | A | * | 2/1994 | Numajiri et al. | 445/26 |
| 5,877,591 | A | * | 3/1999 | Nagata et al. | 220/2.1 R |
| 5,962,976 | A | | 10/1999 | Irisawa et al. | 313/623 |
| 6,249,086 | B1 | * | 6/2001 | Honda et al. | 313/352 |
| 6,342,764 | B1 | * | 1/2002 | Nishiura et al. | 313/574 |
| 6,354,900 | B1 | * | 3/2002 | Ohshima et al. | 445/26 |

FOREIGN PATENT DOCUMENTS

| | | | | |
|---|---|---|---|---|
| DE | 199 28 996 A1 | | 12/1999 | H01J/61/36 |
| EP | 0 609 477 A1 | | 8/1994 | H01J/61/36 |
| EP | 0 818 805 A2 | | 1/1998 | H01J/61/36 |
| EP | 0 871 202 A2 | | 10/1998 | H01J/61/36 |
| EP | 0 991 097 A1 | | 4/2000 | H01J/9/04 |
| GB | 2338823 A | * | 12/1999 | H01J/61/36 |
| JP | 11067153 A | * | 3/1999 | H01J/5/32 |

OTHER PUBLICATIONS

Japanese Abstract No. 07226185, dated Aug. 22, 1995.
Japanese Abstract No. 2000100377, dated Apr. 7, 2000.

* cited by examiner

*Primary Examiner*—Nimeshkumar D. Patel
*Assistant Examiner*—Sikha Roy
(74) *Attorney, Agent, or Firm*—Sughrue Mion, PLLC

(57) ABSTRACT

An arc tube, which is capable of prolonging the life thereof by preventing occurrence of a leak caused from a crack of an arc-tube body, has the average surface roughness of each of outer surfaces 26Aa and 26Ba of tungsten electrodes 26A and 26B pinch-sealed to pinch seal portions 20*b*1 and 20*b*2 on the two sides of a light-emission tube 20*a* of an arc-tube body 20 is set to be 3 $\mu$m or smaller. Thus, the state of pinch-sealing of the tungsten electrodes 26A and 26B to the pinch seal portions 20*b*1 and 20*b*2 is brought to a state in which the two elements are engaged with small pits and projections. Therefore, great compressive stress is not left in the region adjacent to the joint surface between the pinch seal portions 20*b*1 and 20*b*2 and the tungsten electrodes 26A and 26B as distinct from the conventional structure. In a case where a crack of the arc-tube body 20 is formed owing to the residual compressive stress, the crack is limited to a local portion which is the region adjacent to the joint surface. As a result, the crack is not enlarged to reach the surface of the arc-tube body 20.

6 Claims, 6 Drawing Sheets

ARC TUBE CAPABLE OF PREVENTING OCCURRENCE OF LEAK DUE TO CRACKS AND MANUFACTURING METHOD THEREFORE

FIELD OF THE INVENTION

The present invention relates to an arc tube serving as a light source, such as a headlight of a vehicle, and a manufacturing method therefor.

BACKGROUND OF THE INVENTION

In recent years, arc tubes each of which is capable of realizing a high brightness have widely been used as light sources, for example, the headlights of vehicles.

In general, an arc tube serving as a light source, such as a headlight of a vehicle, as shown in FIG. 5, incorporates a quartz glass arctube body 104 having pinch seal portions 104*b* formed on the two sides of a light-emission tube 104*a* constituting a discharge space 102. Moreover, the arc tube incorporates a pair of tungsten electrodes 106 pinch-sealed to the pinch seal portions 104*b* such that the leading ends of the tungsten electrodes 106 project into the discharge space 102.

The arc tube having the above-mentioned structure is arranged such that each of the tungsten electrodes 106 is electrically polished to smooth the surface of each of the tungsten electrodes 106 to obtain a predetermined discharge characteristic.

From a viewpoint of preventing occurrence of a leak from the arc-tube body 104, experiments conducted by the inventors of the present invention resulted in the following fact. That is, the simple electrolytic polishing process which is performed in order to maintain the discharge characteristic cannot attain a satisfactory smoothness of the surface of each of the tungsten electrodes 106.

When the surface of each of the tungsten electrodes 106 has some roughness, the tungsten electrodes 106 and the pinch seal portions 104*b* are engaged to each other with great pits and projections, as shown in FIG. 6, after the tungsten electrodes 106 have been pinch-sealed to the pinch seal portions 104*b*. Therefore, excessively large compressive stress is maintained in a region adjacent to the surfaces of the pinch seal portions 104*b* with which the pinch seal portions 104*b* are joined to the tungsten electrodes 106. The large compressive stress causes a crack of the arc-tube body 104 to occur during use of the arc tube. Thus, a leak occurs been the discharge space 102 and the extena space. Therefore there arises a problem in that the life of the conventional arc tube is unsatisfactorily short.

In view of the foregoing, an object of the present invention is to provide an arc tube which is capable of preventing occurrence of a leak caused from a crack of the arc-tube body so as to prolong the life of the arc tube, and a manufacturing method therefor.

SUMMARY OF THE INVENTION

The present invention is arranged to improve the smoothness of the surfaces of the tungsten electrodes to achieve the foregoing object.

That is, according to one aspect of the present invention, there is provided an arc tube comprising: an arc-tube body which incorporates a light-emission tube arranged to form a discharge space and having pinch seal portions formed on the two sides thereof and which is made of quartz glass; and a pair of tungsten electrodes pinch-sealed to the pinch seal portions such that the leading ends of the pair of tungsten electrodes project into the discharge space, wherein average roughness of the surface of each of the tungsten electrodes is set to be 3 $\mu$m or smaller.

According to another aspect of the present invention, there is provided a method of manufacturing an arc tube incorporating an arc-tube body which incorporates a light-emission tube arranged to from a discharge space and having pinch seal portions formed on the two sides thereof and which is made of quartz glass; and a pair of tungsten electrodes pinch-sealed to the pinch seal portions such that the leading ends of the pair of tungsten electrodes project into the discharge space, the method of manufacturing an arc tube comprising the steps of: inserting and disposing a tungsten electrode to portions of a quartz glass tube in which pinch seal portions are formed; and pinch-sealing the portions in which the pinch seal portions are formed in a state where the portions in which the pinch seal portions are formed are heated to 2000° C. or higher so that each pinch seal portion is formed.

The "tungsten electrode" may be made of pure tungsten or a material to which the other components are added in a case where the main component of the base material of the tungsten electrode is tungsten.

The "surfaces of the tungsten electrodes" must include the surfaces of the portions which are pinch-sealed to the pinch seal portions. Therefore, the "surfaces of the tungsten electrodes" are not required to be the overall surfaces.

The arc tube according to the present invention and having the above-mentioned structure arranged such that the pair of tungsten electrodes are pinch-sealed to the pinch seal portions formed on the two sides of the light emission tube of the arc-tube body such that the leading ends of the pair of tungsten electrodes project into the discharge space. Each of the tungsten electrodes has the surfaces exhibiting excellent smoothness such that the average roughness of the surface of each of the tungsten electrodes is 3 $\mu$m or smaller. Therefore, the following operations and effects are obtained.

That is, when the tungsten electrodes are pinch-sealed to the pinch seal portions, the two elements are engaged to each other with small pits and projections. Therefore, a problem experienced with the conventional structure due to an undesirable great compressive stress left in the surfaces of the pinch seal portions in which the pinch seal portions are joined to the tungsten electrodes can be prevented.

Therefore, when a crack of the arc-tube body ours owing to the residual compressive stress during use of the arc tube, the crack is limited to a local portion, which is a region adjacent to the joining surface. That is, the crack is not enlarged to reach the surface of the arc-tube body. As a result, occurrence of a leak between the discharge space and the external space can be prevented.

Therefore, the arc tube according to the present invention arranged to prevent a leak occurring due to a crack of the arc-tube body enables its life to be prolonged.

According to another aspect of the present invention, there is provided a method of manufacturing an arc tube incorporating an arc-tube body which incorporates a light-emission tube arranged to form a discharge space and having pinch seal portions formed on the two sides thereof and which is made of quartz glass, and a pair of tungsten electrodes pinch-sealed to the pinch seal portions such that the leading ends of the pair of tungsten electrodes project into the discharge space, the method of manufacturinan arc tube comprising the steps of inserting and disposing a tungsten electrode, arranged such that the mean surface roughness is 3 μm or smaller, into portions of a quartz glass tube in which pinch seal portions are formed; and pinch-sealing the portions in which the pinch seal portions are formed in a state where the portions in which the pinch seal portions are formed are heated to 2000° C. or higher so that each pinch seal portion is formed. Therefore, the following operation and effect can be obtained.

That is, when the tungsten electrodes are pinch-sealed to the pinch seal portions, the two elements are engaged to each other with small pits and projections. Therefore, a problem experienced with the conventional structure due to the undesirable great compressive stress left in the surfaces of the pinch seal portions in which the pinch seal portions are joined to the tungsten electrodes can be prevented.

Therefore, when a crack of the arc-tube body occurs owing to the residual compressive stress during use of the arc tube, the crack is limited to a local portion, which is a region adjacent to the joining. That is, the crack is not enlarged to reach the surf of the arc-tube body. As a result, occurrence of a leak between the discharge space and the external space can be prevented.

The portions in which the pinch seal portions are formed are heated to a high temperature of 2000° C. or higher when a pinch sealing operation is performed. Therefore, the bonding strength between the tungsten electrodes and the pinch seal portions can be increased Therefore, small compressive stress is left in a wide range in a region adjacent to the joining surfaces between the pinch seal portions and the tungsten electrodes Therefore, the crack of the arc-tube body occuring during use of the arc tube owing to the residual compressive stress is uniformly distributed in the region adjacent to the joining surface. Therefore, extension of the crack to the other portion can effectively be prevented. As a result occurrence of a leak between the discharge space and the external space can furthermore reliably be prevented.

Therefore, employment of the method of manufacturing an arc tube according to the present invention enables the life of the arc tube to further more be prolonged.

DETAIL DESCRIPTION OF THE INVENTION

Referring the drawings, an embodiment of the present invention will now be described.

Figure 1:
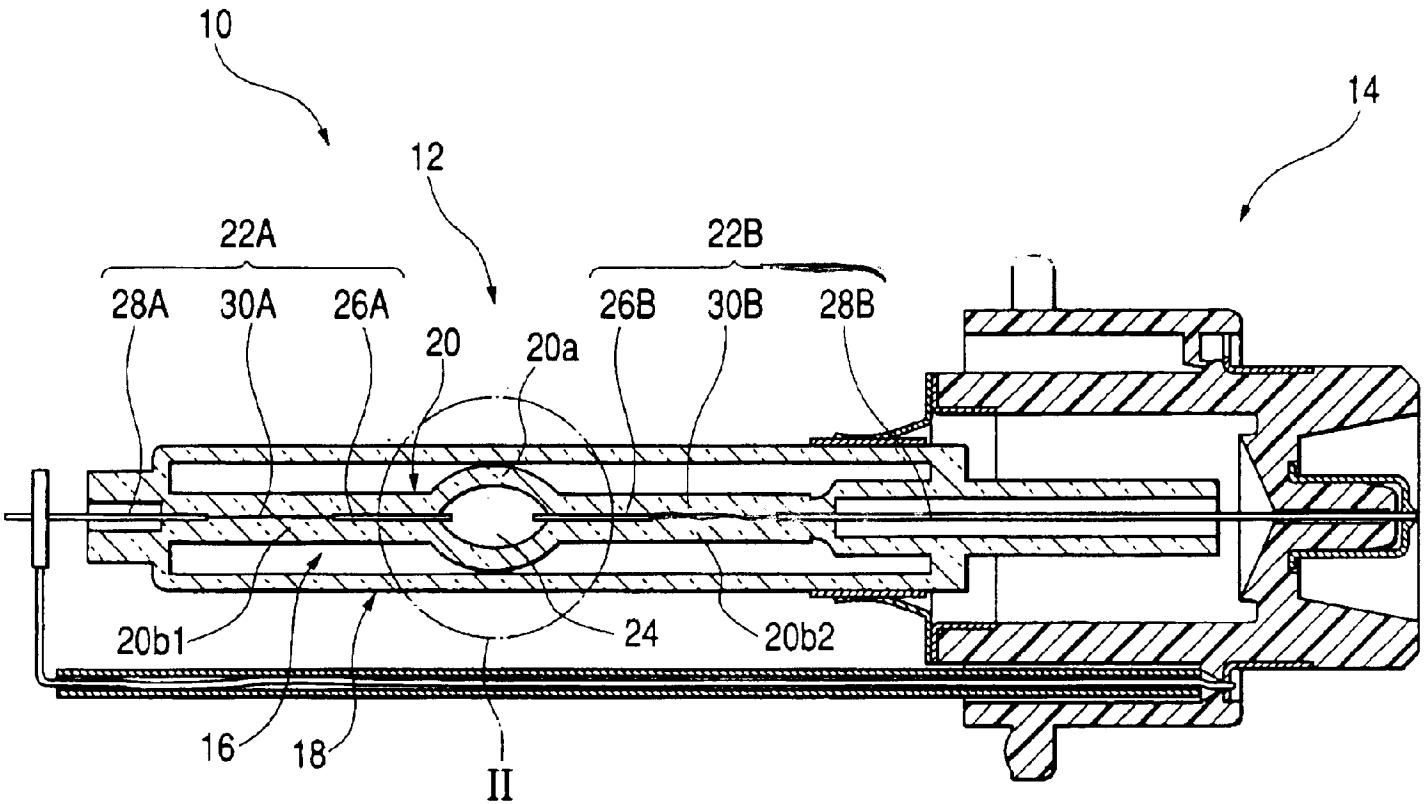
FIG. 1 is a side cross sectional view showing a discharge bulb which includes an arc tube according to an embodiment of the present invention.
Figure 2:
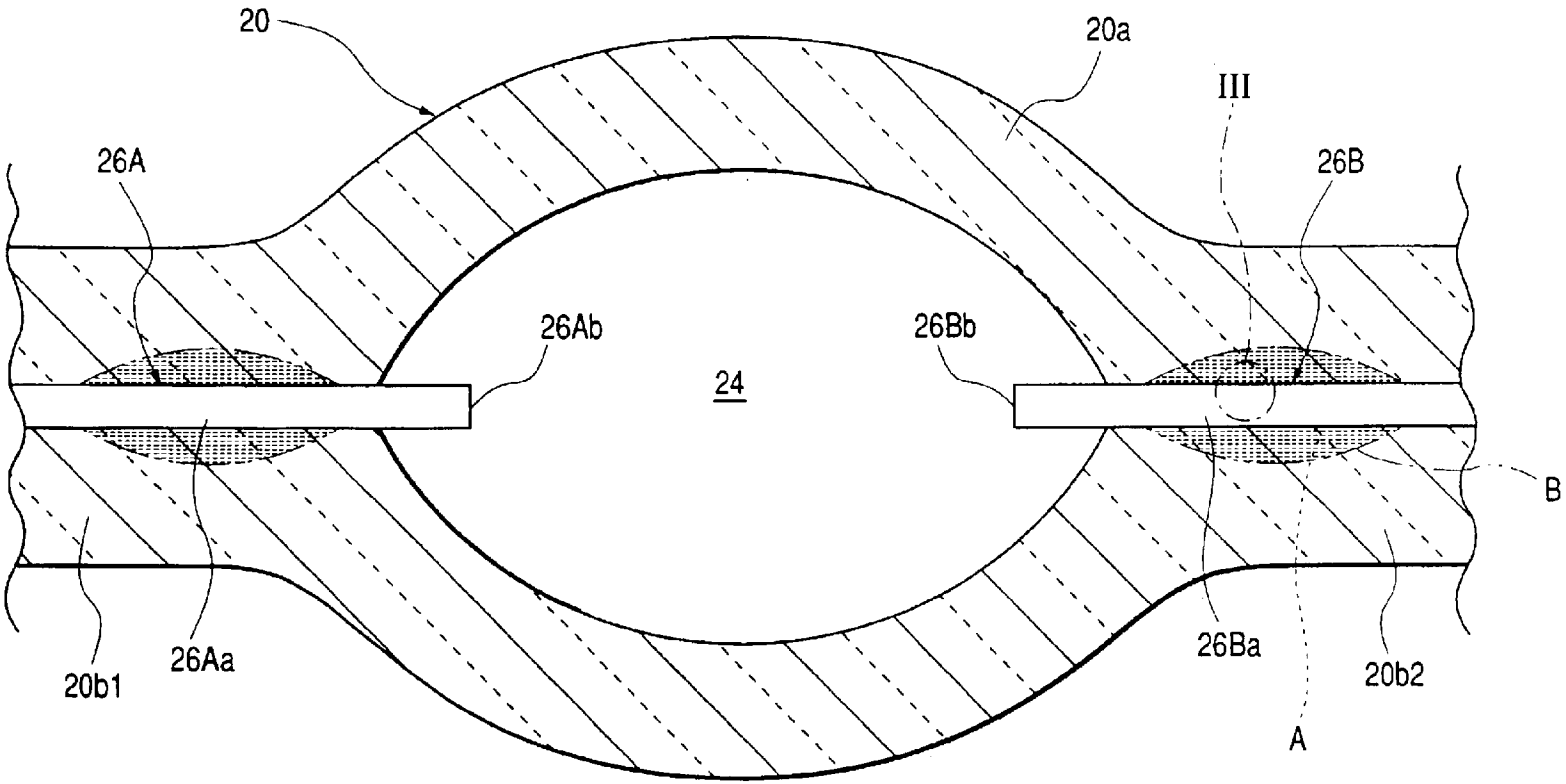
FIG. 2 is an enlarged view showing the portion II shown in FIG. 1.

FIG. 1 is a side cross sectional view showing a discharge bulb 10 in which an arc tube according to this embodiment is included. FIG. 2 is an enlarged view of the portion II.

As shown in FIGS. 1 and 2, the discharge bulb 10 is a light source bulb which is mounted on a headlight of a vehicle. The discharge bulb 10 incorporates an arc-tube unit 12 extending in the lengthwise direction and an insulating plug unit 14 for securing and supporting the rear end of the arc-tube unit 12.

The arc-tube unit 12 is constituted by integrally forming an arc tube 16 and a shroud tube 18 surrounding the arc-tube 16.

The arc tube 16 is constituted by an arc-tube body 20 obtained by machining a quartz glass tube and a pair of front and rear electrode assemblies 22A and 22B embedded in the arc-tube body 20.

The arc-tube body 20 has a light-emission tube 20*a* formed in the central portion thereof, the light-emission tube 20*a* being formed into substantially an elliptic shape. Moreover, pinch seal portions 20*b*1 and 20*b*2 are fromed at the front and rear portions of the light-emission tube 20*a*. A substantially elliptic-shape discharge space 24 extends lengthwise in the light-emission tube 20*a*. Xenon gas and a metal halide are enclosed in the discharge space 24.

The electrode assembles 22A and 22B have structures such that rod-shape tungsten electrodes 26A and 26B and lead wires 28A and 28B are connected and securely to one another through molybdenum foil members 30A and 30B. The electrode assemblies 22A and 22B are pinch-sealed to the arc-tube body 20 in the pinch seal portions 20*b*1 and 20*b*2. The molybdenum foil members 30A and 30B are completely embedded in the pinch seal portions 20*b*1 and 20*b*2. The tungsten electrodes 26A aid 26B project into the discharge space 24 such that their leading ends are opposite to each other in the lengthwise direction Each of the tungsten electrodes 26A and 26B is constituted such that treated tungsten (tungsten to which thorium oxide is doped by several %) is the base material. Each of outer surfaces 26Aa and 26Ba of the tungsten electrodes 26A and 26B is subjected to a strong electrolytic polishing process. Thus, the arithmetical mean deviation of profile Ra of each of the outer surfaces 26Aa and 26Ba is 3 μm or smaller (note that the cut-off value λc=0.8 mm and the evaluated length In=4 mm). Leading end surfaces 26Ab and 26Bb of the tungsten electrodes 26A and 26B are barrel-polished. The corner R of each of the leading end surfaces 26Ab and 26Bb is about 0.04 mm to about 0.06 mm to obtain a satisfactory discharge characteristic.

Figure 3:
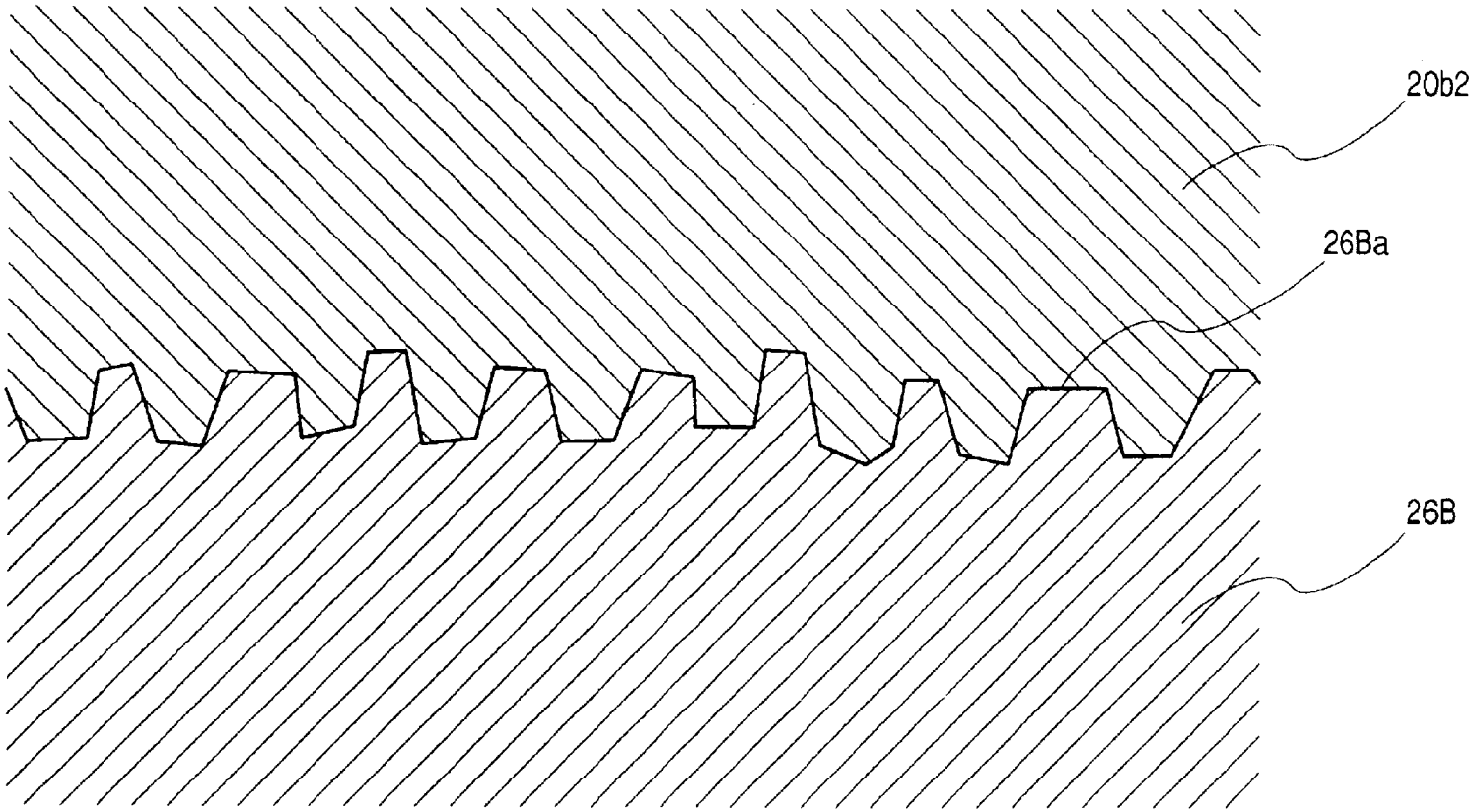
FIG. 3 is an enlarged view showing the portion III shown in FIG. 2.

FIG. 3 is an enlarged view of the portion III shown in FIG. 2 to illustrate a state of the surface with which the tungsten electrode 26B and the pinch seal portion 20*b*2 are joined to each other after the discharge bulb 10 has been turned on/off several times. Also the rice of joining between the other tungsten electrode 26A and the pinch seal portion 20*b*1 realizes a similar state.

As shown in FIG. 3, the arithmetical mean deviation of profile Ra of the outer surface 26Ba is made to be 3 μm or smaller. Therefore, when the tungsten electrode 26B has been pinch-sealed to the pinch seal portion 20*b*2, the two element are engaged to each other with small pits and projections. Hence it follows that undesirable retention of great compressive stress in a region adjacent to the joint surface between the pinch seal portion and the tungsten electrode experienced with the conventional structure can be prevented.

Therefore, when a crack of the arc-tube body 20 occurs during use of the arc tube 16 owing to the residual compressive stress, the crack is limited to a local portion, which is the region adjacent to the joining surface. That is, a crack of a type that quartz glass is finely broken occurs in a dashed-line region A shown in FIG. 2. A mirror-shape interface B as indicated with an alternate long and two short dashes line is formed in the pinch seal portion 20*b*2. Therefore, formation of a great crack which reaches the s of the arc-tube body 20 can be prevented. As a result, occurrence of a leak between the discharge space 24 and the external space can be prevented.

Figures 4A, 4B, 4C, 4D:
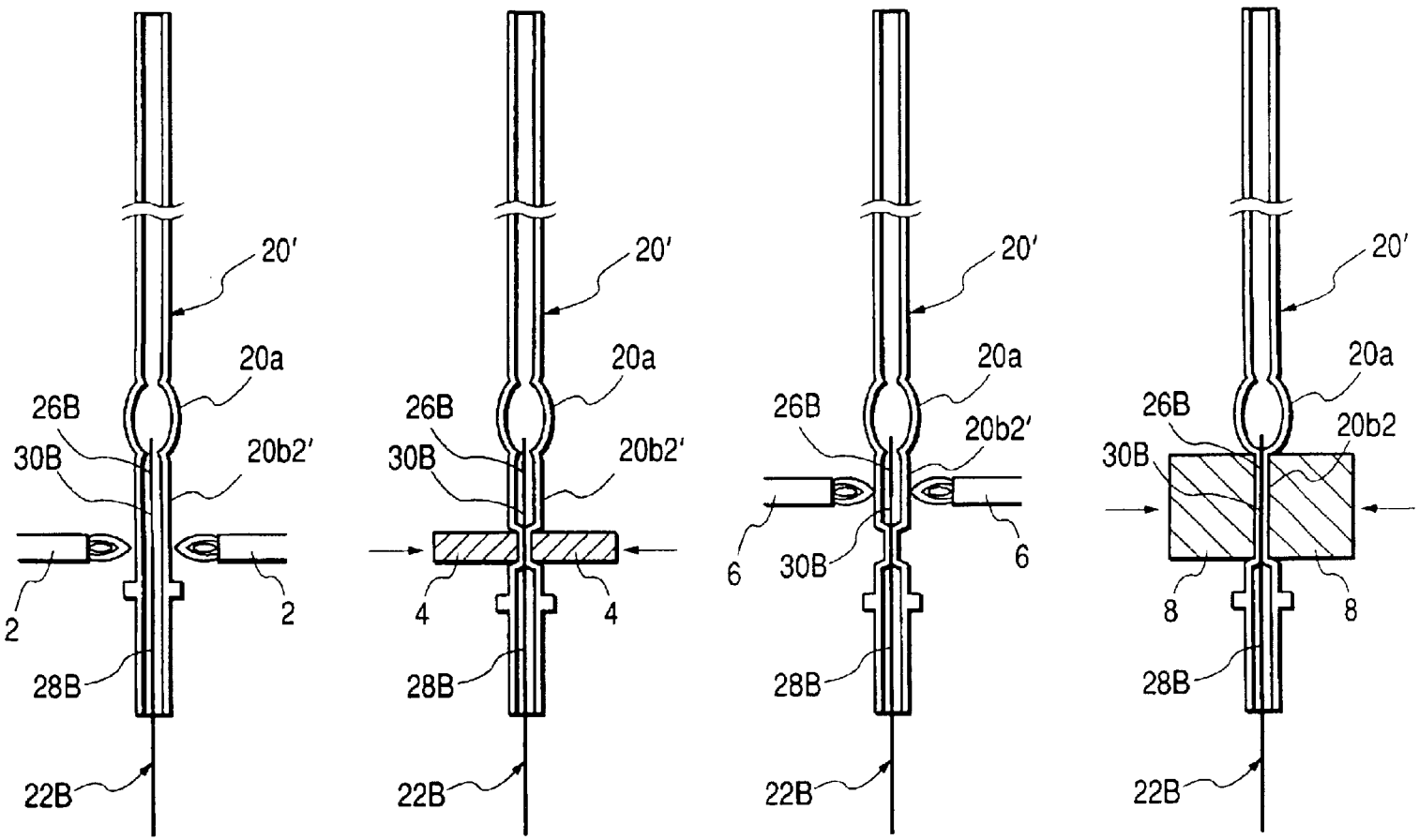
FIG. 4 is a diagram showing a pinch sealing press, according to an embodiment of the present invention, for pinch-sealing a tungsten electrode to a portion of a quartz glass tube in which the pinch seal portion is formed.
Figure 5:
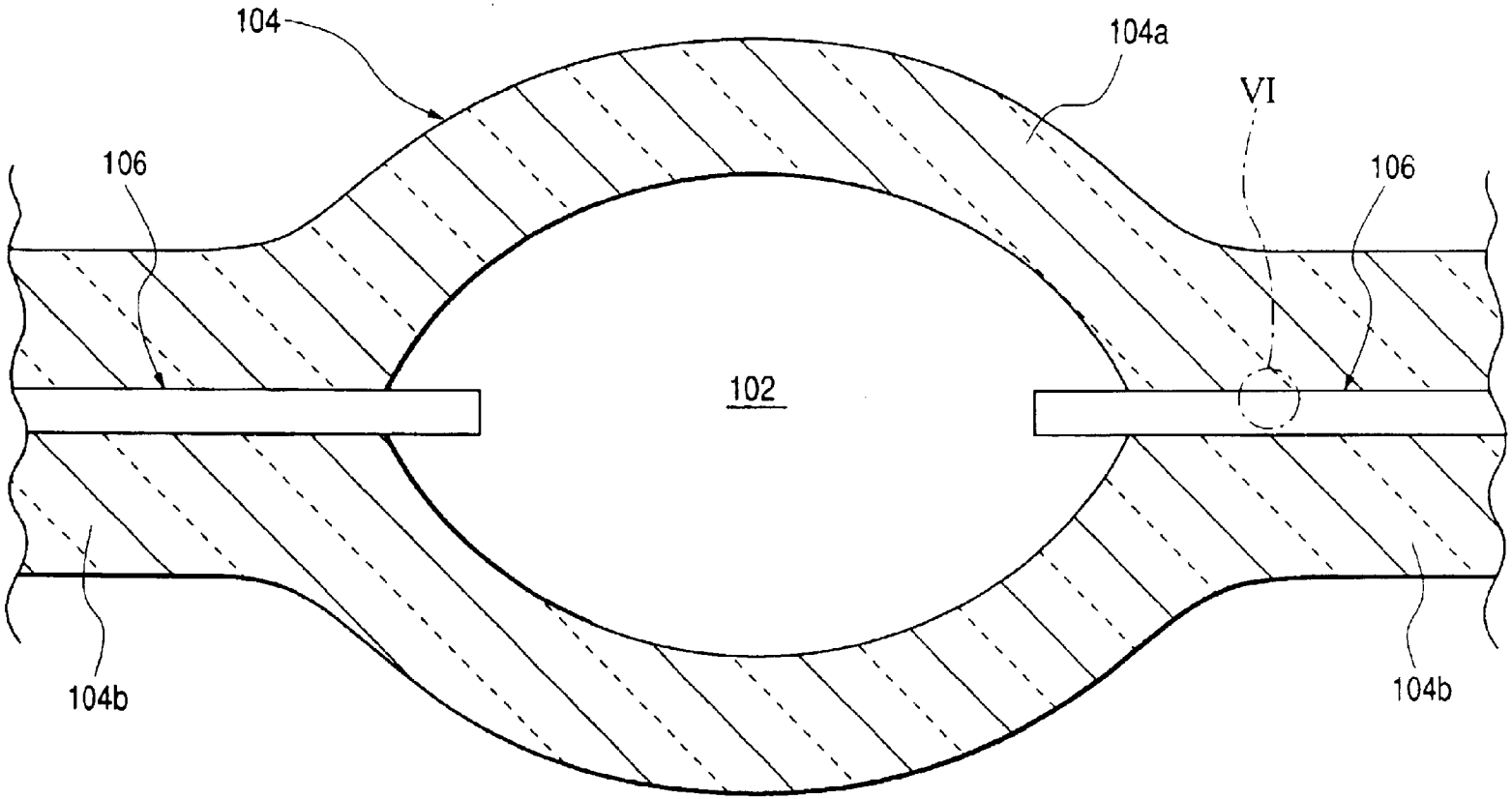
FIG. 5 is a diagram showing a conventional example of an arc tube.
Figure 6:
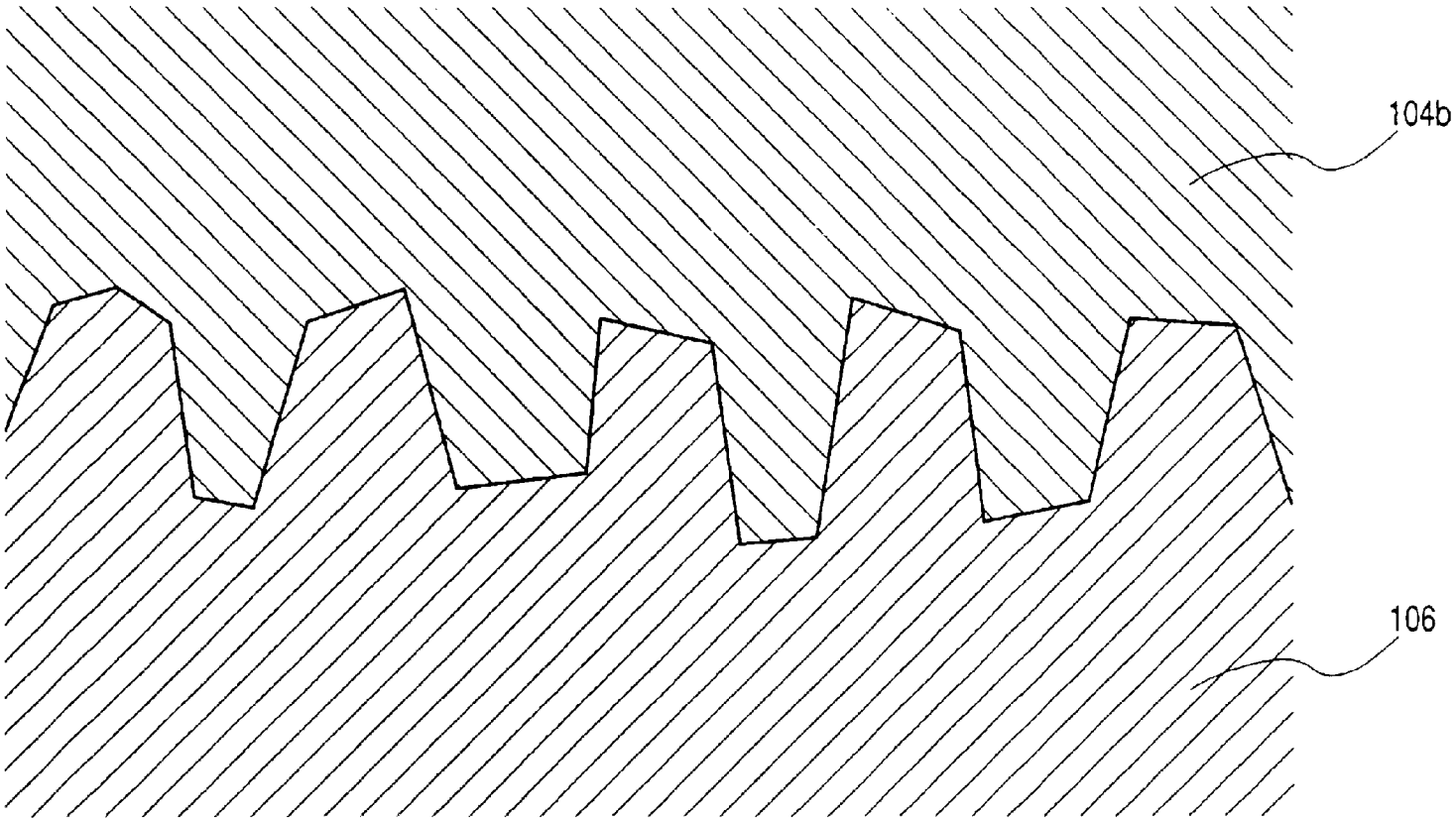
FIG. 6 is an enlarged view showing the portion VI shown in FIG. 5.

FIG. 4 is a diagram showing a pinch-sealing step for pinch-sealing the tungsten electrode 26B to a portion 20*b*2' of a quartz glass tube 20' in which the pinch seal is formed.

Initially, as shown in FIG. 4 (*a*), a state is realized in which the electrode assembly 22B is inserted into a predetermined position from a position lower than the quartz glass tube 20' which is formed into the arc-tube body 20 having the light-emission tube 20*a*. Then, the lower end of the portion 20*b*2' in which the pinch seal is formed is heated by a burner 2. Thus, as shown in FIG. 4 (*b*), a temporal pincher 4 is operated to temporarily pinch-seal the electrode assembly 22B to the foregoing lower end.

Then, as shown in FIG. 4 (*c*) the portion 20*b*2' in which the pinch seal is formed is heated to 2000° C. or higher (preferably 2100° C. to 2200° C.) by a burner 6. In the foregoing state as shown in FIG. 4 (*d*), a main pinch-sealing process is performed so that the electrode assembly 22B is pinch-sealed to the portion 20*b*2' in which the pinch seal is formed by operating a main pincher 8. Thus, the pinch seal portion 20*b*2 is formed.

Thus, the portion 20*b*2' in which the pinch seal is formed is heated at a high temperature of 2000° C. or higher when the main pinch sealing of the portion 20*b*2' in which the pinch seal is formed is performed. Therefore, the bonding strength between the tungsten electrode 26B and the pinch seal portion 20*b*2 of the electrode assembly 22B can be increased. As a result small compressive stress is uniformly left in a wide range in the region adjacent to the joint s between the pinch seal portion 20*b*2 and the tungsten electrode 26B.

Therefore, the cracks of the adobe body 20 occuring during use of the arc tube 16 owing to the residual compressive stress is substantially uniformly distributed in the region adjacent to the joint surface. The above-mentioned mirror-shape interface can easily be formed. Moreover, extension of the crack to the other portion can effectively be prevented. Therefore, occurrence of a leak between the discharge space 24 and the external space can furthermore reliably be prevented.

Table 1 shows the relationship between the surface roughness (the arithmetical mean deviation of profile Ra) of the outer sure of the tungsten electrode and the life (mean life Tc and initial defect generation time B3) of the arc tube. Table 2 shows the relationship between the temperature t to which the portion in which the pinch seal is formed when the main pinch sealing process is performed is heated and the life of the arc tube (mean life Tc and initial defect generation time B3).

TABLE 1

Relationship between Arithmetical Mean Deviation Profile Ra and Life (n = 20) temperature to be raised: t = 2000° C.

| Arithmetical Mean Deviation of Profile Ra | Mean Life Tc (hr) | Initial Defect Generation Time B3 (hr) | Evaluation |
|---|---|---|---|
| 5 μm | 893 | 186 | X |
| 4 μm | 1145 | 207 | ○ |
| 3 μm | 1915 | 800 | ○ |

TABLE 1-continued

Relationship between Arithmetical Mean Deviation Profile Ra and Life (n = 20) temperature to be raised: t = 2000° C.

| Arithmetical Mean Deviation of Profile Ra | Mean Life Tc (hr) | Initial Defect Generation Time B3 (hr) | Evaluation |
|---|---|---|---|
| 2 μm | 2234 | 982 | ⊙ |
| 1 μm | 2578 | 1055 | ⊙ |

TABLE 2

Relationship between Temperature to be Raised and Life (n = 20) arithmetical mean deviation of profile Ra: 3 μm

| Temperature t | Mean Life Tc (hr) | Initial Defect Generation Time B3 (hr) | Evaluation |
|---|---|---|---|
| 1800° C. | 856 | 69 | X |
| 1900° C. | 859 | 81 | X |
| 2000° C. | 1915 | 800 | ○ |
| 2100° C. | 2107 | 843 | ⊙ |
| 2300° C. | 2235 | 875 | ⊙ |

As can be understood from Table 1, the above-mentioned setting that the arithmetical mean deviation of profile Ra is 3 μm or smaller enables the mean life to be about 2000 hours or longer. As can be understood from Table 2, the temperature t to which the portion in which the pinch seal portion is formed is made to be 2000° C. or higher when the main pinch sealing process is performed. Thus, a mean life of about 2000 hours or longer can be realized.

Note that the mean life Tc shown in the two tables is time at which 63.2% of all of the samples encounters problems (the arc tube cannot be turned on). Initial defect generation time B3 is time at which 3% of all of the samples encounters problems (the arc tube cannot be turned on). When also the mean life Tc is used, dispersion of the life can be detected.

As described above, the arc tube 16 according to the embodiment incorporates the tungsten electrodes 26A and 26B pinch-sealed to the pinch seal portions 20*b*1 and 20*b*2 on the two sides of the light-emission tube 20*a* of the arc-tube body 20. The tungsten electrodes 26A and 26B exhibit excellent surface smoothness such that the arithmetical mean deviation of profile Ra of each of the outer surfaces 26Aa and 26Ba is 3 μm or smaller. When the tungsten electrodes 26A and 26B have been pinch-sealed to the pinch seal portions 20*b*1 and 20*b*2, the two elements are engaged to each other with small pits and projections. As a result, retention of great compressive stress in the region adjacent to the joint surface between the pinch seal portions 20*b*1 and 20*b*2 and the tungsten electrodes 26A and 26B can be prevented.

Therefore, when a crack of the arc-tube body 20 occurs during use of the arc tube 16 owing to the residual compressive stress, the crack is limited to a local portion which is the region adjacent to the joint surface. That is, the crack is not enlarged to reach the surface of the arc-tube body 20. As a result, occurrence of a leak between the discharge space 24 and the external space can be prevented. Hence it follows that the life of the arc tube 16 can be prolonged.

In this embodiment, the pinch sealing process is performed in a state where the portion 20*b*2' of the quartz glass tube 20' in which the pinch seal is formed is heated to 2000° C. or higher so that the pinch seal portion 20*b*2 is formed. Therefore, the bonding strength between the tungsten electrode 26B and the pinch seal portion 20*b*2 is increased. As a result, small compressive stress is substantially uniformly left in a wide range in a region adjacent to the joint surface between the pinch seal portion 20*b*2 and the tungsten electrode 26B. The foregoing also applies to the region adjacent to the joint surface between the pinch seal portion 20*b*1 and the tungsten electrode 26A.

Therefore, the crack of the arc-tube body 20 occurring during use of the arc tube 16 owing to the residual compressive stress is substantially uniformly distributed in the region adjacent to the joint surface. Therefore, extension of the crack to the other portion can effectively be prevented. Thus, occurrence of a leak between the discharge space 24 and the external space can furthermore reliably be prevented. Hence it follows that the life of the arc tube 16 can be prolonged.

In this embodiment, the lower end of the portion 20*b*2' in which the pinch seal is formed is heated (refer to FIG. 4 (*a*)) by the burner 2 prior to performing the temporal pinch sealing operation shown in FIG. 4 (*b*). The foregoing heating process does not directly concern the bonding strength between the tungsten electrode 26B and the pinch seal portion 20*b*2. Therefore, no description has been made about the temperature to which the lower end must be heated. As a matter or course, the temperature may be 2000° C. or higher similarly to the main pinch sealing process.

In this embodiment, arithmetical mean deviation of profile Ra of the outer surfaces 26Aa and 26Ba of the tungsten electrodes 26A and 26B is made to be 3 μm or smaller. Moreover, the portion 20*b*2' in which the pinch seal is formed is heated to 2000° C. or higher when the main pinch sealing process is performed. As can be understood from Tables 1 and 2, it is preferable that the arithmetical mean deviation of profile Ra is 2 μm or smaller. Moreover, it is preferable that the temperature is made to be 2100° C. or higher. In the foregoing case, the life of the arc tube 16 can furthermore be prolonged.

In this embodiment, the arc tube is the arc tube 16 for a discharge bulb 10 which is mounted on a headlight of a vehicle. As a matter of course, the arc tube according to this embodiment may be applied to another purpose.

What is claimed is:

1. A method of manufacturing an arc tube, the arc tube including an arc-tube body, which incorporates a light-emission tube arranged to form a discharge space and has pinch seal portions formed on two sides thereof, the tube being made of quartz glass, and a pair of tungsten electrodes pinch-sealed to the pinch seal portions such that leading ends of the pair of tungsten electrodes project into the discharge space, said manufacturing method comprising:

inserting and disposing the tungsten electrodes, which have an average surface roughness of 3 μm or smaller, into portions of the tube in which the pinch seal portions are formed; and pinch-sealing the portions of the tube at a temperature equal to or greater than 2000° C., thereby forming the pinch seal portions.

2. The method of manufacturing an arc tube as claimed in claim 1, wherein said tungsten electrode is subjected to a strong electrolytic polishing process.

3. The method of manufacturing an arc tube as claimed in claim 2, wherein the temperature at which the pinch seal portions are formed is equal to or greater than 2100° C.

4. The method of manufacturing an arc tube as claimed in claim 1, wherein said tungsten electrode has an average surface roughness of 2 μm or smaller.

5. An arc tube comprising:

an arc-tube body which incorporates a light-emission tube having a discharge space and pinch seal portions formed on two sides of said discharge space, said tube being made of a quartz glass; and a pair of tungsten electrodes pinch-sealed to said pinch seal portions, respectively, such that leading ends of said pair of tungsten electrodes project into said discharge space, wherein average roughness of a surface of each of said tungsten electrodes in contact with said pinch seal portions is 3 μm or smaller.

6. The arc tube as claimed in claim 5, wherein the average roughness is 2 μm or smaller.

* * * * *